United States Patent [19]

White

[11] Patent Number: 4,788,785

[45] Date of Patent: Dec. 6, 1988

[54] FOLDABLE STOCK EXTENSION FOR FIREARM

[75] Inventor: Bernard C. White, Robbinsdale, Minn.

[73] Assignee: Napco Industries, Inc., Hopkins, Minn.

[21] Appl. No.: 102,226

[22] Filed: Sep. 29, 1987

[51] Int. Cl.[4] ..... F41C 23/00
[52] U.S. Cl. ..... 42/72
[58] Field of Search ..... 42/71.01, 72, 73

[56] References Cited

U.S. PATENT DOCUMENTS

| | | | |
|---|---|---|---|
| 2,293,128 | 8/1942 | Fortin | 42/72 |
| 2,400,349 | 5/1946 | Haberstump | 42/72 |
| 3,798,819 | 3/1974 | Hillberg | 42/72 |
| 4,513,523 | 4/1985 | Gal | 42/72 |

*Primary Examiner*—Ted L. Parr
*Attorney, Agent, or Firm*—Faegre & Benson

[57] ABSTRACT

A foldable firearm stock for use with a grenade launcher or other weapon. A hinged butt portion, when moved into the folded configuration releases the lock permitting the stock frame to pivot from an extended position to a storage position above and aligned with the weapon barrel.

5 Claims, 2 Drawing Sheets

FOLDABLE STOCK EXTENSION FOR FIREARM

BACKGROUND OF THE INVENTION

1. Field of the Invention

The present invention relates to firearms in general and more particularly to foldable stock extensions and auxiliary grips applicable to firearms such as grenade launchers, for example.

2. Description of the Prior Art

Devices are already known for application to machine pistols and the like to serve as a stock or butt therefore and improve their grip and handling during use. For example, the German MP38 and MP40 and a number of other machine pistols employed a pivotal stock portion which pivoted from a point behind the receiver beneath the hand grip to a collapsed position with the two parallel stock portions on both sides of the receiver and forestock into a folded position. The British Sten Mark II machine guns also employed folding stocks pivoting about a vertical axis at the butt of the receiver in order to achieve a closed position beside the receiver.

However, readily and reliably lockable and unlockable stock extension means for grenade launchers have heretofore not been utilized.

SUMMARY OF THE INVENTION

A foldable stock for a firearm, comprises, in combination a grip portion, a frame member and butt portion, a link, a slide and locking means. The grip portion is constructed and arranged for attachment to the firearm adjacent the receiver portion thereof.

The elongated frame member has a longitudinal channel therein and a butt portion hingedly attached thereto at one end thereof and movable from an extended position generally perpendicular to the frame to a folded position essentially parallel to the frame. The frame member is pivotally attached at the other end thereof to the grip portion with the channel opening oriented downwardly and enclosing at least a portion of the top of the grip. The frame member is pivotally movable from an extended position projecting rearwardly from the receiver to a folded position above and essentially parallel to the barrel of the firearm.

The link is attached at one end thereof to the end of the butt portion distal from the pivotal connection to the frame.

The slide is connected to the other end of the link and positioned in the channel of the frame member and movable between a first defined position for supporting the butt portion in the extended position and a second defined position wherein the butt portion is in the folded position parallel to the frame and the link is also aligned with the frame portion.

The locking means has a tongue extending from the grip portion, the tongue being spring loaded and constructed and arranged for being forced against the spring force into the grip when the slide is forced into contact with it as the butt portion is moved to the folded position thereby permitting the locking means to be withdrawn from the channel of the frame member and allowing the frame to be pivoted to the folded position.

BRIEF DESCRIPTION OF THE DRAWINGS

Further details of the invention are apparent from the following description, with reference to the illustrative embodiment shown in the accompanying, drawings in which.

DETAILED DESCRIPTION OF THE PREFERRED EMBODIMENTS

Figure 1:
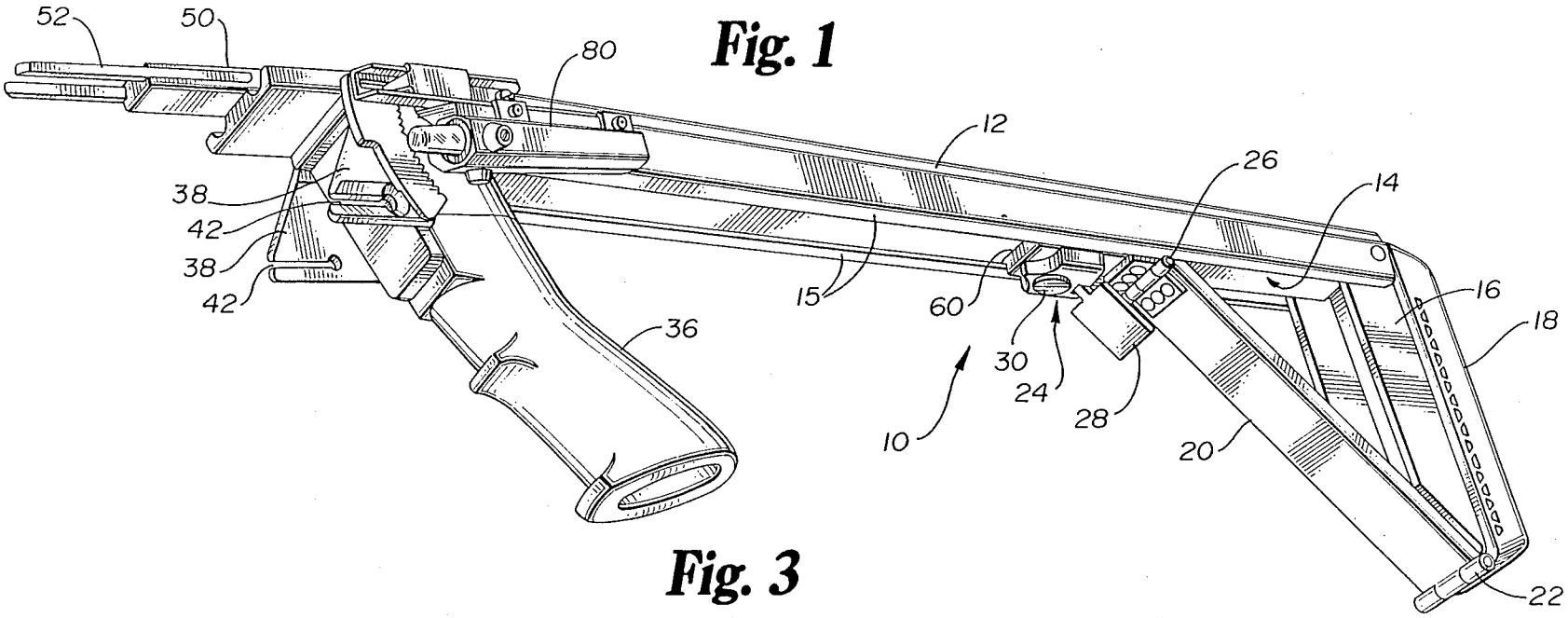
FIG. 1 is a perspective view of the foldable stock extension with an auxiliary grip comprising the present invention.

Referring now to the drawings, the foldable stock 10 is shown in FIG. 1 in the fully opened position. The particular stock shown is specifically configured for use with an M203 grenade launcher although other embodiments can be utilized with other firearms without departing from the invention claimed.

The stock 10 is comprised of a frame portion 12 which has an open channel 14 along its bottom surface as shown in FIG. 1. The walls of channel 14 can include flanges 15 as shown to partially enclose channel opening. At the butt end of frame portion 12 a butt stock portion 16 is pivotally attached. A resilient cushion 18 is attached to the surface of butt stock portion 16 to cushion the arm of the user. Butt stock portion 16 is foldable into a collapsed position at least partially enclosed within the side walls of channel 14 of frame 12 when the stock is in the folded position.

A support link 20 is hingedly mounted at one end 22 thereof to the opposite end of butt stock 16 from the end which is pivotally connected to frame 12. The other end of link 20 is hingedly connected to a slide 24 by a hinge 26.

Figure 3:
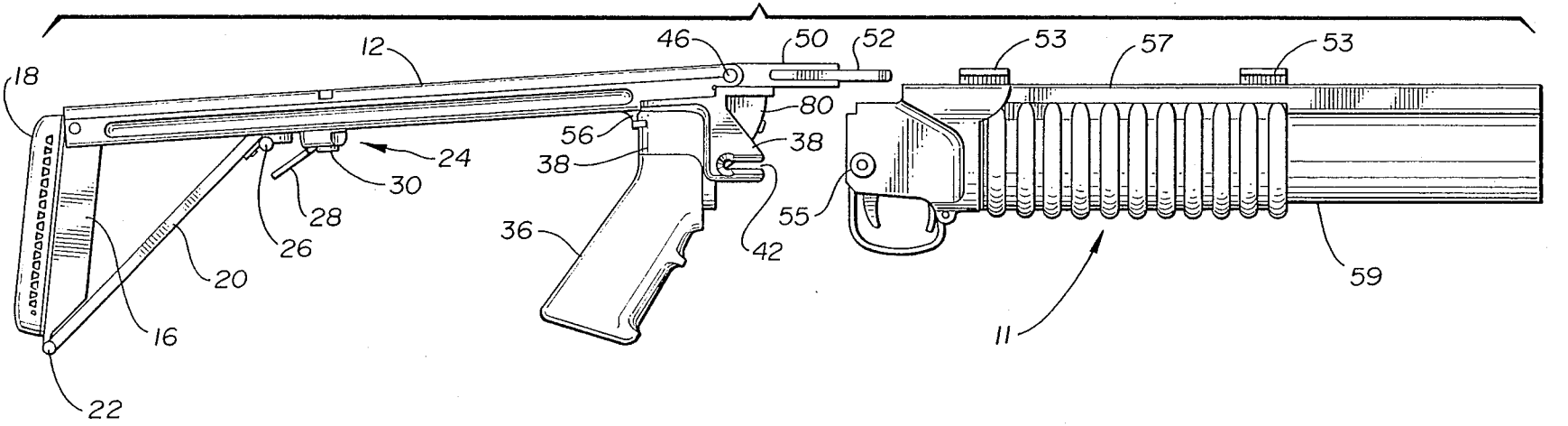
FIG. 3 is a partially exploded view of the grip structure shown next to an M203 type grenade launcher modified in accordance with the present invention.
Figure 2:
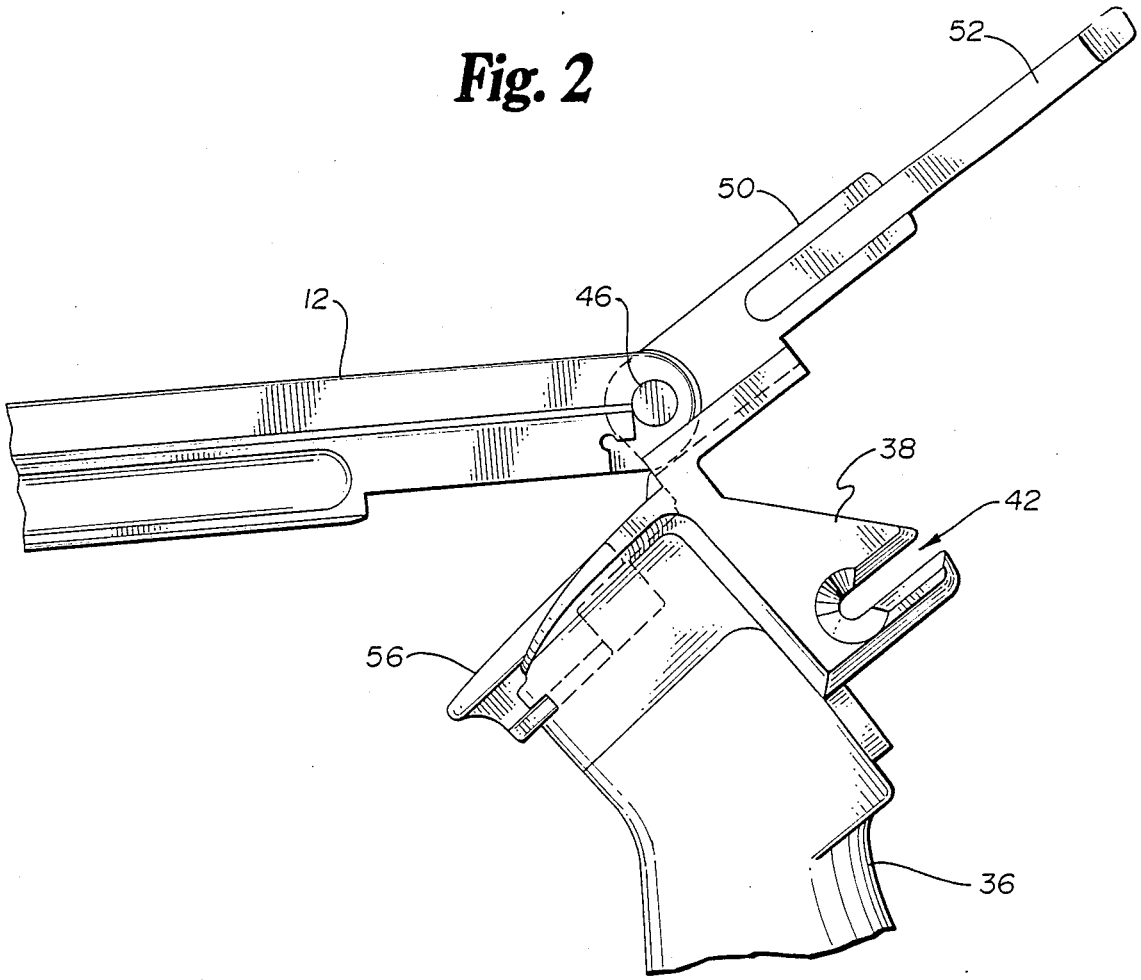
FIG. 2 is a detailed view of the auxiliary grip portion and the lock used to secure the pivotal frame.

A locking handle 28 is used to secure slide 24 in either an opened locking position as shown in FIG. 1 or in a closed and collapsed locking position by a movable pin or dog 30 which is insertable into a corresponding hole in frame 12 through the floor of channel 14. Also shown in FIG. 1 is a grip portion 36 which, as shown in FIG. 2, has a head portion 38 formed thereon which is constructed and arranged for engaging the rear portion of a receiver of a firearm. As shown in FIG. 3, the slot 42 in portion 38 passes over the shank of the receiver bolt 44 projecting from the butt portion of the receiver of the firearm.

In FIG. 3, the firearm shown specifically is a modified M203 grenade launcher. The launcher is shown with a bar in the top surface thereof with a pair of dogs for engaging a quick disconnect interbar mounted below the barrel of an assault rifle for example.

Also shown in FIG. 2 is the detail of the pivotal connection of the frame 12 and the head 38 of grip 36. A pivot pin 46 allows for pivotal movement of frame 12 relative to grip 36. A projecting grip head portion 50 and a fixed tongue 52 are constructed and arranged for engaging a lug or dog projecting from the top surface of the modified M203 grenade launcher so that the foldable stock is removably secured by engagement with tongue 52 and grip head portion 50 and by the bolt which is inserted through the slot 42 in the head portion 38.

In FIG. 2, the frame 12 is shown in the partially pivoted position. If frame 12 is rotated about pivot pin 46 in an anticlockwise direction, it is engaged by spring loaded dog 56 which can be forced into the handle grip head 38 against the force of an internal spring, not specifically shown. When frame 12 is pivoted in the counterclockwise position, dog 56 can be forced inwardly by slide 24, into the head 38 of handle portion 36 until the flanges 15 are engaged with the projecting sides of dog 56 and the internal spring forces dog 56 securely into channel 14 of frame 12 thereby securing the frame against further pivotal movement in either direction.

In order to collapse the foldable stock 10, handle 28 is actuated to move pin 30 out of the aperture in the frame 12 and allow the butt stock 16 to pivot in the clockwise direction as viewed in FIG. 1 about the pivot point at the butt end of frame 12. As the butt stock 16 is folded against frame 12, link 20 pushes the forward edge 60 of slider 24 into contact with dog 56 forcing dog 56 inwardly against the internal spring force into the head portion 38 of handle 36 to allow frame 12 to be pivoted about the pivot axis 46 as shown in FIG. 2. Frame 12 is then freely pivotal for approximately 180 degrees until it comes to rest essentially in alignment with the top surface of the barrel of the firearm. An appropriate locking mechanism secures frame 12 from inadvertent opening after it is engaged with the top surface of the barrel of the firearm. In the collapsed position, the butt stock 16 is folded so that only cushion 18 projects from frame 12 on the side of frame 12 which is directed outwardly from the surface of the barrel of the firearm.

A suitable sighting device 80 can be affixed to the top portion 38 of grip 36 which is fixedly mounted relative to the firearm so that recalibration of the sight is not required as the folding stock is folded and opened. Additionally, the folding action of the stock does not interfere with the calibration or orientation of the sight device 80.

It is apparent that a weapon with the folding butt stock described above has extreme utility. The ease of operation of the collapsible stock is accentuated by the fact that the slider 24 operates to compress dog 56 as the stock is opened or closed to allow the pivotal movement of frame 12 into and out of a collapsed position above the barrel of the firearm in a quick and simple movement without the need of adjusting nuts or multiple release actuators. Finally, all these advantages are provided by a simple mechanism that is easy to maintain.

Although the present invention has been described with reference to preferred embodiments, workers skilled in the art will recognize that changes may be made in form and detail without departing from the spirit and scope of the invention.

What is claimed is:

1. A foldable stock for a firearm, said stock comprising, in combination:

(a) a grip portion constructed and arranged for attachment to the firearm adjacent the receiver portion thereof;

(b) an elongated frame member having a longitudinal channel therein and a butt portion hingedly attached thereto at one end thereof and movable from an extended position generally perpendicular to the frame to a folded position essentially parallel to the frame, the frame member pivotally attached at the other end thereof to the grip portion with a channel opening oriented downwardly and enclosing at least a portion of the top of the grip; said frame member being pivotally movable from an extended position projecting rearwardly from the receiver to a folded position above and essentially parallel to the barrel of the firearm;

(c) a link attached at one end thereof to the end of the butt portion distal from the pivotal connection to the frame;

(d) a slide connected to the other end of the link and positioned in the channel of the frame member and movable between a first defined position for supporting the butt portion in the extended position and a second defined position wherein the butt portion is in the folded position parallel to the frame and the link is also aligned with the frame portion; and (e) locking means having a, tongue, extending from the grip portion into the channel, the tongue being spring loaded and constructed and arranged for being forced against the spring force into the grip when the slide is forced into contact with it as the butt portion is moved to the folded position thereby permitting the locking means to be withdrawn from the channel of the frame member and allowing the frame to be pivoted to the folded position.

2. A foldable stock for a firearm, said stock comprising, in combination:

(a) a grip portion constructed and arranged for attachment to the firearm adjacent the receiver portion thereof;

(b) an elongated frame member having a longitudinal channel therein, the frame member pivotally attached at one end thereof adjacent to the top of the grip portion with a channel opening oriented downwardly and enclosing at least a portion of the top of the grip; said frame member being pivotally movable from an extended position projecting rearwardly from the receiver to a folded position above and essentially parallel to the barrel of the firearm;

(c) locking means mounted on the grip portion for selectively restraining the elongated frame member in the extended position;

(d) a slide positioned in the channel of the frame member movable between an extended locking position adjacent the butt end of the frame member and a collapsed locking position adjacent the receiver end of the frame member;

(e) a link attached at one end thereof to the slide; and (f) a butt member hingedly affixed at one end thereof to the other end of the frame member, the other end of the butt member attached to the other end of the link, the butt member constructed and arranged for supportive contact with the shoulder of a user when the frame member is in the extended position and for pivoting into a position parallel to the frame member when the slide is in the collapsed locking position, said slide constructed and arranged for operating the locking means to release the frame member from the extended position.

3. The invention of claim 2 wherein the locking means is a spring loaded tongue means projecting from the grip portion for engaging the channel of the frame member, when extended and restraining pivoted movement thereof and for permitting pivoted movement of the frame member when the slide member forces the tongue member into the grip portion against the spring force.

4. The invention of claim 2 wherein further locking means are provided for locking the frame member to the firearm barrel when the frame member is in the collapsed locking position.

5. The invention of the claim 2 wherein the slide includes a lever actuated bottom which is insertable into apertures in the frame member defining the extended and collapsed locking positions.

* * * * *